United States Patent [19]

Goral

[11] 4,135,374

[45] Jan. 23, 1979

[54] BICYCLE LOCK

[76] Inventor: Adam H. Goral, R.R. #5, Lake Canton, Ill. 61520

[21] Appl. No.: 867,519

[22] Filed: Jan. 6, 1978

[51] Int. Cl.[2] ..... E05B 73/00

[52] U.S. Cl. ..... 70/18; 70/227

[58] Field of Search ..... 70/18, 14, 15, 226, 70/227, 225, 233

[56] References Cited

U.S. PATENT DOCUMENTS

| | | | |
|---|---|---|---|
| 1,305,563 | 6/1919 | Poland | 70/227 |
| 1,333,878 | 3/1920 | Smith | 70/15 |
| 1,354,172 | 9/1920 | Courtney | 70/18 |

FOREIGN PATENT DOCUMENTS

| | | | |
|---|---|---|---|
| 74801 | 10/1918 | Austria | 70/18 |
| 22791 | 11/1948 | Finland | 70/227 |

*Primary Examiner*—Robert L. Wolfe

*Attorney, Agent, or Firm*—Lee & Smith

[57] ABSTRACT

A two piece locking device for a bicycle or the like is constructed from a clevis and a link, wherein the clevis has a pair of mutually orthogonal eyelets at its open end and the link is adapted to be placed first over the eyelet out of the plane of the clevis and then over the eyelet in that plane. A padlock may be positioned with its shackle through the second eyelet to secure the clevis and link in locked engagement with one another.

7 Claims, 4 Drawing Figures

Fig. 1.
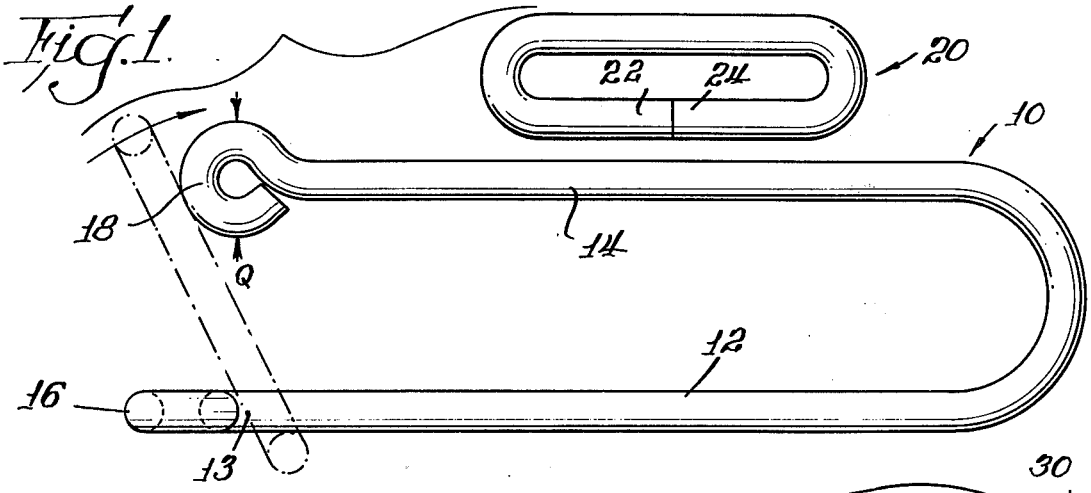
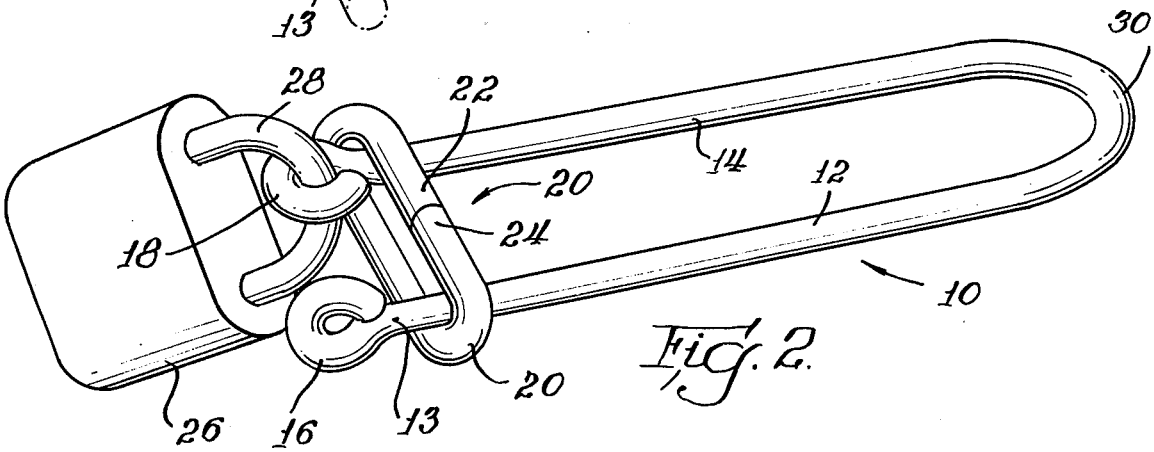
Fig. 2.
Fig. 3.
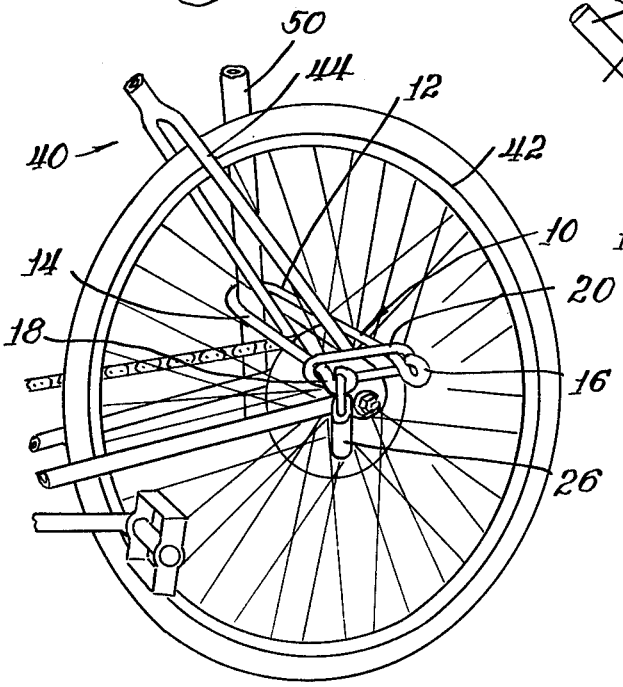
Fig. 4.
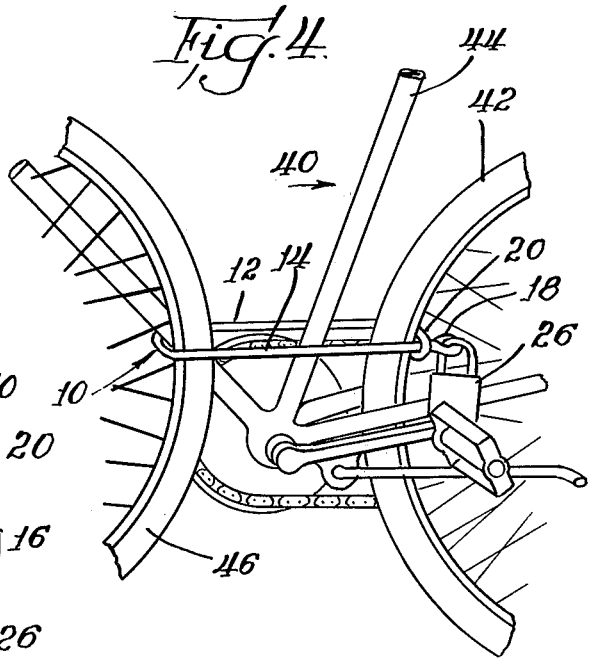

BICYCLE LOCK

BACKGROUND OF THE INVENTION

1. Field of the Invention

The invention is related to locking devices used to restrict movement for security purposes, and is directly related to a lock construction secured by a padlock or the like. The locking device of the present invention is particularly useful for securing a bicycle or the like to a stationary object.

2. Description of the Prior Art

In general, bicycle locks have served as more of a moral deterrent to theft than as an actual security device for effectively immobilizing the locked bicycle. Many could be easily broken in a matter of seconds without the use of special tools. Thus, only the "casual" thief or bicycle "joyrider" would be deterred. Determined thieves could often swiftly solve these locks while attracting little, if any, attention to themselves.

Bicycle locks which have served to substantially protect a bicycle from more determined attacks with more specialized burglary equipment, while effective in varying degrees are often prohibitively expensive and/or heavy. While cost may not be a controlling factor to a bicycle enthusiast, one of the most important factors serious cyclists consider is the weight of their bicycles. However, since lighter bikes generally are more expensive, a cyclist who pays more for a lightweight bicycle could lose this advantage by carrying a durable, effective heavy lock with him to protect his investment.

Another disadvantage of many bicycle locks is the bulkiness in design and difficulty in handling. Substantial and lengthy chains often used to form part of these locks often must be wrapped around the bicycle frame when not in use. Other locks utilize wide bands of metal which also often prove to be cumbersome and difficult to store when not in use.

Further, many bicycle locks are not designed to fasten the bicycle to a stationary object, but are only adapted for locking one part of the bicycle to another. These locks do nothing to prevent a thief from merely picking up the whole bicycle and stealing not only the bicycle but also the lock designed to protect it. An example of this type of locking device is disclosed in U.S. Pat. No. 3,766,757.

Despite the disadvantages of known locks, they have been successful in the market place because of the great need for a cyclist to protect his investment.

The locking device of the present invention serves to minimize the problems cyclists have in providing security for their bicycles, without being cumbersome to store and without adding greatly to the weight of the bicycle. The locking device is made of a clevis and a link which, when used in conjunction with a padlock or the like, forms a simple yet effective means to immobilize a bicycle, the device being impervious to all but the most time-consuming attacks involving special tools. The invention may be constructed of relatively lightweight materials and is relatively easy to store on the bicycle when not in use. The device readily permits securing of the bicycle to a stationary object and is so used in its preferred form. However, where necessary, the device is also effective for securing various parts of the bicycle to one another for immobilizing it when a suitable stationary object is not readily available.

SUMMARY OF THE INVENTION

The present invention is directed to a locking device having members which are secured in locking engagement with one another by a standard padlock or the like for securing a bicycle to a stationary object or, in the alternative, for effectively immobilizing a bicycle by securing its various parts to one another. Of course, it will be understood that the locking device is equally useful for securing and immobilizing many vehicles in addition to a bicycle and this disclosure is made keeping this expanded use in mind.

The locking device comprises a substantially U-shaped clevis adapted for receiving parts of the bicycle and where desirable, a stationary object, and a link which closes the open end of the clevis. Both the clevis and the link are constructed of rigid material as, for example, case hardened steel.

The U-shaped clevis has an integral eyelet formed at each end, with one eyelet disposed in a plane substantially perpendicular to that of the clevis, and the other eyelet disposed substantially in the plane of the clevis. The link is adapted to receive the first eyelet, and then be rotated about the clevis leg and placed over the second eyelet which is disposed in the plane of the clevis and therefore, is orthogonal to the first eyelet. A padlock can then be placed through this second eyelet for firmly securing the link and clevis in locked engagement with one another.

In the preferred embodiment, the two legs of the clevis are of different length, the eyelet perpendicular to the plane of the clevis being an integral part of the longer leg. This minimizes the size of the link required to fit over the eyelets and close the clevis, thus reducing the possible shifting of the link during use without detracting from the security of the lock.

The locking device is simple and easy to manufacture, yet provides an effective means for securing a bicycle while addiing relatively little weight to the load carried by the cyclist when the locking device is stored. The device readily permits the bicycle to be locked to a stationary object, such as a bike rack or post. When a stationary object is not readily available, the locking device may be used to effectively immobilize the bicycle by securing its various parts to one another. The device is simple to use, easy to store on the bicycle and, when stored, does not greatly detract from the bicycle's appearance or add to the bicycle's weight.

BRIEF DESCRIPTION OF THE DRAWINGS

FIG. 1 is an illustration of the components of a locking device according to the present invention.

FIG. 2 is an illustration of the device of FIG. 1 with the components shown in an assembled, locked condition.

FIG. 3 is an illustration of the device as used to secure the bicycle to a stationary object.

FIG. 4 is an illustration of the device as used to immobilize the bicycle by securing its various parts to one another.

DETAILED DESCRIPTION OF THE PREFERRED EMBODIMENTS

With reference to the drawings, FIG. 1 shows the substantially U-shaped rigid clevis 10, preferably formed of a single piece of bar stock and having a first leg 12 and second leg 14 and a pair of mutually orthogonal eyelets 16 and 18 integral with the legs at the open end of the clevis. As shown, eyelet 16 is a continuation of the first leg 12 and is disposed in a plane perpendicular to the plane defined by the legs of the U-shaped clevis. Eyelet 18 is a continuation of the second leg 14 and is disposed in the plane defined by the legs of the clevis.

The rigid link 20 is used with the U-shaped clevis 10 and is placed over the eyelets 16 and 18 to close the open end of the clevis. In the preferred embodiment, the leg 12 is somewhat longer than the leg 14, by an amount approximately equal to twice the diameter of the bar stock from which the U-shaped clevis is constructed. This minimizes the length required of link 20 in order to enable it to freely pass over the second eyelet 18. Preferably, the diameter of each eyelet is approximately three times the diameter of the bar stock. Thus, if leg 12 is longer than leg 14 by a distance at least 1½ times the diameter of the bar stock, the end point 13 of the first leg 12 is directly opposite the widest part "Q" of the eyelet 18. When the link 20 is placed over eyelet 16, the link 20 may be readily rotated around leg 12 about point 13 and over eyelet 18 while utilizing the shortest distance between the leg 12 and the eyelet 18. Therefore, the link 20 can be the shortest possible length for a particular clevis 10.

In the preferred embodiment, link 20 is also constructed of the rigid bar stock used for clevis 10. There is no need for welding the two ends 22 and 24 together, although this may be done if desired. It should, of course, be understood that while the link is shown as an "O" shaped loop other configurations may be used without departing from the scope and spirit of the invention.

The link and clevis components are shown in assembled, locked relationship in FIG. 2, wherein link 20 is positioned over the eyelets 16 and 18 and on the legs 12 and 14 of the clevis 10. A common padlock 26 is employed to maintain the clevis and link in locked engagement by positioning its shackle 28 through the eyelet 18. The shackle of the padlock locks the link member 20 on leg 14, whereas the link is held firmly on leg 12 solely by the eyelet 16. By disposing eyelet 16 in a plane orthogonal to the plane of clevis legs, the need for a hinge, sliding bar, receptacle or other weak joint has been eliminated.

By way of example, an effective bicycle lock according to the present invention may be manufactured to the following specifications, which are included herein only for purposes of illustration. The clevis and link components may be 1040 case hardened steel, roundstock, one-half inch diameter, and use of this material will keep the overall weight of the lock in the range of two and one-half pounds. The curved end 30 of the clevis is defined by a radius of 1¼ inches, which is large enough to successfully employ the invention and avoid metal stress which would weaken the invention, yet small enough to be easily stored and carried on the bicycle. The eyelets 16 and 18 are formed in a free flow manner from the legs 12 and 14 and have an external diameter of 1½ inches. The short leg 14 extends 10 inches from the end of the curved end 30 to the second eyelet 18, whereas the long leg 12 extends 11 inches. The link 20 is of the same bar stock as the clevis and defines a slot which is 4⅛ inches by 9/16 inches. These dimensions of the slot permit easy use of the invention while minimizing the slack between the link 20 on the clevis 10 when the device is locked.

In FIG. 3 the locking device of the invention is shown used to effectively secure a bicycle 40 by restricting the movement of the rear wheel 42 of the bicycle relative to the frame 44 and in addition, by securing the bicycle 40 to a stationary object such as, by way of example, the post 50.

In FIG. 4, the locking device is shown used to effectively immobilize the bicycle 40 by placing clevis 10 through the rear wheel 42, frame 44 and front wheel 46 of the bicycle.

Although not related to function, it should be noted that any of the above embodiments can easily be coated with a rubberized or plasticized covering to reduce noise and prevent scratching of the locked member. Further, it will be understood that the invention is not limited to locking only bicycles or motorcycles. However, bicycles are the most useful application of the invention.

While certain features and embodiments of the invention have been described in detail herein, it should be understood alternatives and modifications may be employed without departing from the scope and spirit of the invention as defined by the appended claims.

What is claimed is:

1. A bicycle lock comprising:

a. a one piece, rigid, clevis having two legs meeting in a U-shaped curve, the first leg having a first eyelet integral therewith and disposed in a plane intersecting the plane defined by the said legs, and the second leg having a second eyelet integral therewith and disposed in the said plane defined by the said legs;

b. a one piece, rigid, closed link adapted to fit over the eyelets and around the clevis for closing the open end of the clevis, and c. means passing through the second eyelet for securing the link on the second leg of the clevis, wherein the link is secured on the clevis by the first eyelet and the said means.

2. The bicycle lock according to claim 1, wherein the first leg is of greater length than the second leg.

3. The bicycle lock according to claim 1, wherein the two eyelets are mutually orthogonal.

4. The bicycle lock according to claim 1; wherein the link and clevis are constructed of case hardened steel bar stock.

5. The bicycle lock according to claim 1, wherein the rigid link forms a substantially closed loop.

6. The device according to claim 2, wherein the clevis and link are constructed of bar stock of cylindrical cross-section, wherein the eyelets are of an outside diameter equal to approximately three times the diameter of the bar stock and wherein the first leg is longer than the second leg by approximately 1½ times the diameter of the bar stock.

7. A bicycle lock comprising:

a. a one piece, rigid, clevis having two legs meeting in a U-shaped curve, the first leg having a first member integral therewith and disposed in a plane intersecting the plane defined by the said legs, and the second leg having a second member integral therewith and disposed in the said plane defined by the same legs;

b. a one piece, rigid, closed link adapted to fit over the members and around the clevis for closing the open end of the clevis, and c. means releasably secured to the second member for securing the link on the second leg of the clevis, wherein the link is secured on the clevis by the first member and the said means.

* * * * *